United States Patent [19]

Faure et al.

[11] Patent Number: 4,584,830

[45] Date of Patent: Apr. 29, 1986

[54] METHOD FOR PRODUCING A FIBER-SPUN YARN

[75] Inventors: Jean L. Faure, Noley; Marcel Schoumacher, Roanne, both of France

[73] Assignee: ASA S.A., Villeurbanne, France

[21] Appl. No.: 693,624

[22] Filed: Jan. 22, 1985

[30] Foreign Application Priority Data

Feb. 24, 1984 [FR] France ..... 84 03083

[51] Int. Cl.[4] ..... D01H 5/28; D02G 3/36; D02G 3/38

[52] U.S. Cl. ..... 57/328; 57/5; 57/6; 57/12

[58] Field of Search ..... 57/328, 5, 6, 12, 293

[56] References Cited

U.S. PATENT DOCUMENTS 4,351,146 9/1982 Faure et al. ..... 57/328 X 4,488,397 12/1984 Venot ..... 57/328

4,489,540 12/1984 Faure et al. ..... 57/328 X

*Primary Examiner*—John Petrakes

*Attorney, Agent, or Firm*—Parkhurst & Oliff

[57] ABSTRACT

A method of obtaining a core-spun yarn, according to which the fibers are subjected to a momentary false twist, and elementary fibers are projected on the spun yarn in the upwardly twisting area by means of a movable surface. According to the invention, all of the fibers (core and sheath) are subjected to the action of a common drawing system. After drawing, part of the fibers are delivered to the guiding surface to form the sheath while the other part of the fibers, which will form the core, is moved away from said surface and returned in contact therewith downstream of the zone in which the first part of the fibers are delivered. It is possible with this method to obtain, from only one supply, a variety of yarns of which the core and sheath can be composed of fibers of the same or of a different nature.

8 Claims, 13 Drawing Figures

METHOD FOR PRODUCING A FIBER-SPUN YARN

The present invention relates to an improvement in spinning techniques for producing fiber yarns and more particularly fiber yarns produced according to the methods described in French patent applications Nos. 82/01382 and 82/15830, which are equivalents to U.S. Pat. No. 4,489,540.

The invention is more particularly concerned with an improvement for obtaining fiber yarns with a structure such that they have a central core constituted of discontinuous fibers, said core being covered with an external sheath which is likewise constituted of discontinuous fibers, of the same or different nature.

As described in U.S. Pat. No. 4,489,540, the fibers designed to form the inner core are subjected to a false twist operation, after which elementary fibers are projected onto the spun yarn, upstream of the false twist spindle. The projection of said elementary fibers onto the core in the upwardly twisting area is achieved by means of a movable guiding surface onto which said fibers are tangentially delivered and which has a tendency to exert a pulling force on the free end of said fibers. The core then is moved tangentially with respect to said guiding surface following a direction which converges with the direction along which fibers are brought.

Preferably, the movable guiding surface is a condensing rotary guide situated at the outlet of the fiber drawing system.

In the case where the core is also constituted by a fiber yarn produced directly on the same machine, a second drawing system is provided for bringing in the fibers designed to form said core.

But it has been found, and this is the object of the present invention, that it was possible to obtain a fiber yarn of the aforesaid type, namely in which the core and the cover are made of discontinuous fibers, with only one drawing system. Such a method considerably increases the possibilities of utilization and can produce varied yarns of which the core and covering part can either be composed of fibers of the same nature, or of fibers of a different nature, and this without any particular adaptation of the equipment being required.

Moreover, the method according to the present invention reduces fiber losses and produces finer and more regular spun yarns.

In general, the present invention relates to an improvement in the method used for obtaining a fiber yarn of the type in which the inner core is also constituted of discontinuous fibers, said method being characterized in that:

the whole fiber assembly (core and covering part) are subjected to the action of a common drawing system;

at the outlet of the drawing system, part of the fibers are progressively delivered onto a movable guiding surface, on which they are held flat, the said surface tending to exert a pulling force on the free end of the fibers whereas the other part of the fibers is kept away from said surface in order to be brought into tangential contact therewith, downstream of the zone in which the first part of the fibers is projected onto said surface.

According to the present invention, what is meant by "common drawing system" is either a single drawing system for all the fibers, or two systems operating simultaneously in parallel.

With this particular method, it is possible to produce core-spun yarns, in which the core and the covering part can be produced from either different or similar materials.

Advantageously however, the fibers will be of different lengths, the fibers designed to form the core being longer than those designed to form the covering part.

The material or materials used for producing a spun yarn according to the invention can be brought to the drawing system either in the form of an intimate mixture or in the form of roves and/or separate tapes.

Moreover, the method according to the invention allows one to vary at will the percentage of each material.

The invention will more readily be understood on reading the following description with reference to the accompanying drawings in which.

Figure 11:
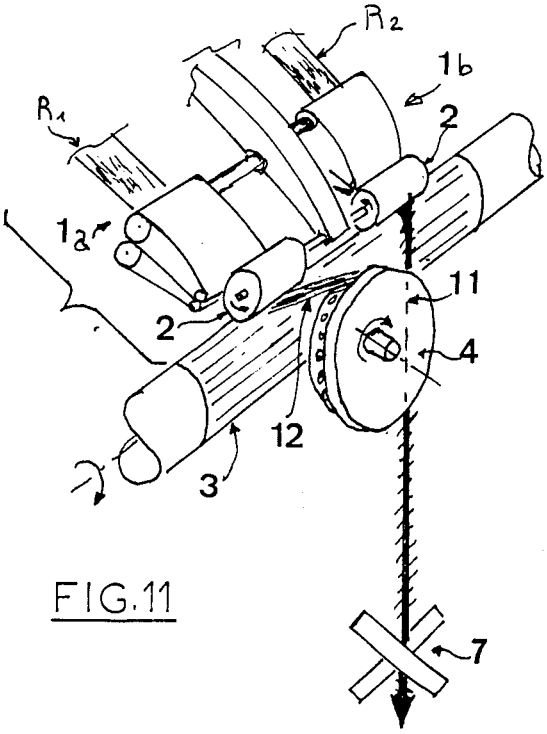
Figure 12:
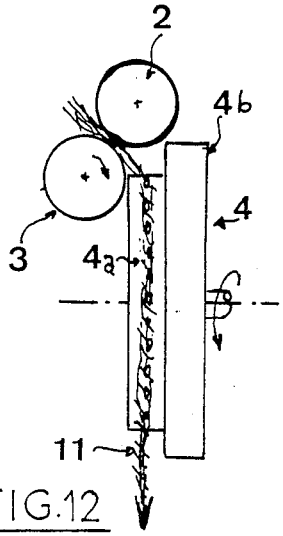
Figure 13:
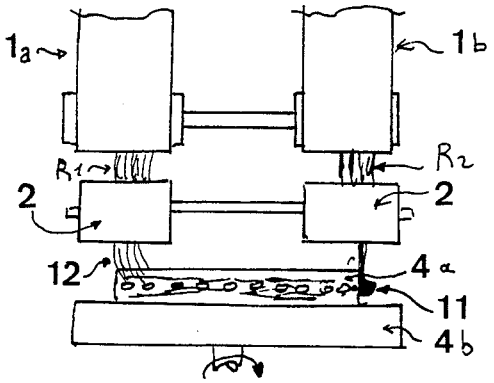

FIGS. 3–4, 5–6, 7–8, 9–10, diagrammatically show four possibilities for carrying out the method according to the invention;

FIG. 11 is a partial perspective of one embodiment of the invention wherein the fibers are brought by a joint drawing system constituted by two drawing frames with sleeves working in parallel;

FIGS. 12 and 13 are respectively, a side view and a plan view showing in more detail the structure of the guiding surface used for carrying out this embodiment and how the fibers are distributed on said guiding surface.

Figure 1:
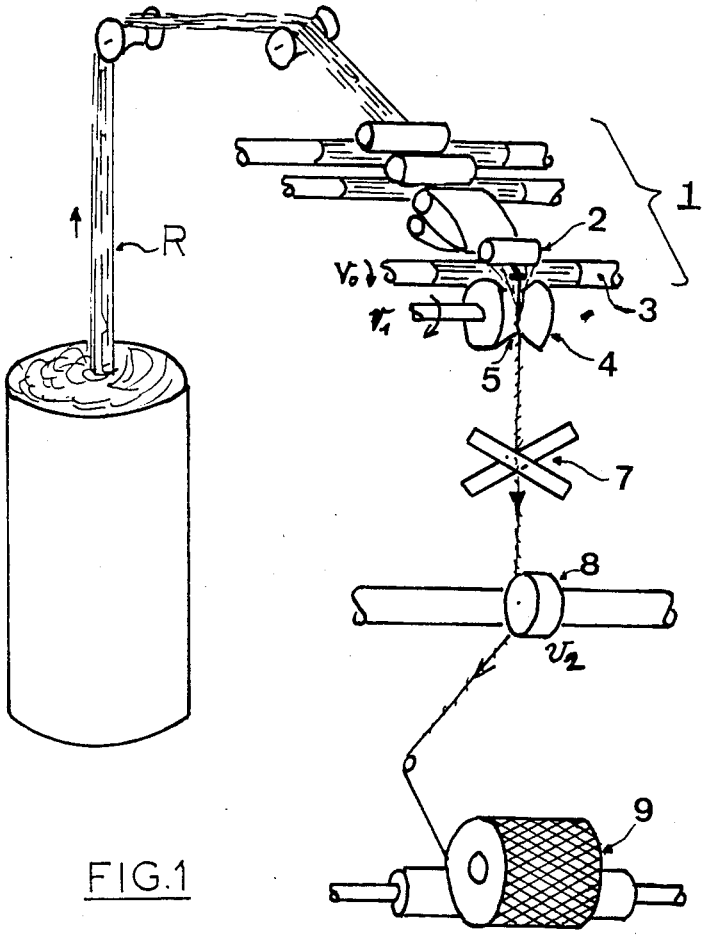
FIG. 1 is a diagrammatical perspective view of an installation for carrying out the method according to the invention, wherein the drawing system is constituted by only one drawing frame of a conventional type with sleeves.
Figure 2:
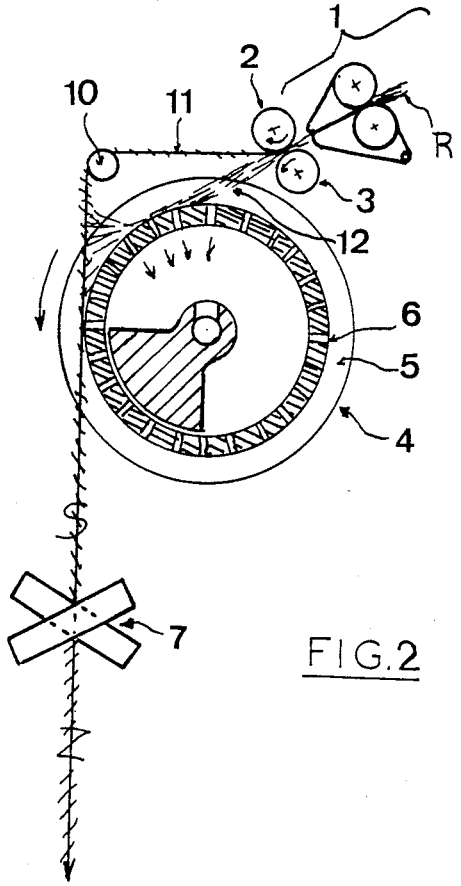
FIG. 2 is a detailed side view showing how the fibers are separated and how the cover fibers are brought onto the core.
Figure 4:
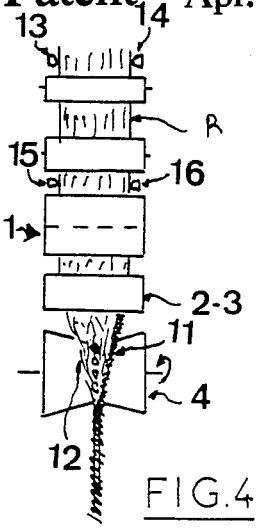
Figure 3:
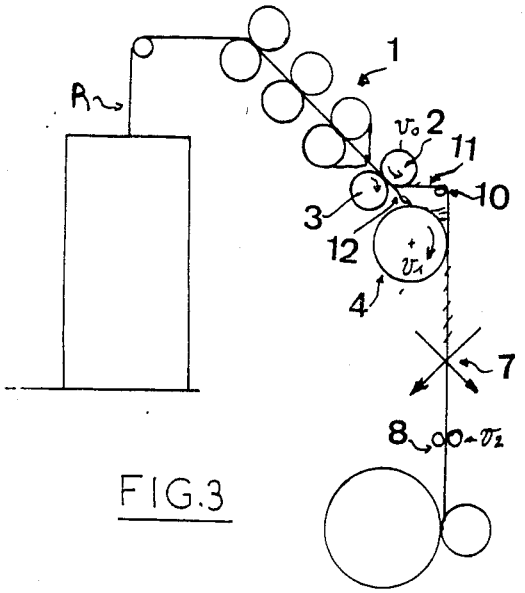

Referring now to the drawings, FIGS. 1, 3, 5, 7 and 9 diagrammatically show a working position of a machine for carrying out the method according to the invention, namely producing in one step a core-spun yarn consisting of a core of discontinuous fibers and a covering part also formed of discontinuous fibers. FIG. 2 shows in more detail how the junction core/covering fibers is made, and FIGS. 4, 6, 8 and 10 show different possibilities to bring the fibers to the common drawing system.

The installation for carrying out the method according to the invention, such as illustrated in the aforesaid figures, essentially comprises a conventional drawing system, one for every working position, designated by the general reference (1), and which, in the illustrated cases, is a conventional system with sleeves, which is well known by anyone skilled in the art and therefore will not be described in detail. Obviously any other equivalent drawing system will also be suitable.

Downstream of the last pair of drawing cylinders (2–3) of the drawing system (1) a guiding surface (4) is provided constituted by a rotary disc, which surface has a peripheral groove (5) which is V-shaped and of which the bottom is perforated with orifices (6) allowing creation of a depression therein. According to this particular embodiment of the invention, the rotary guiding surface is situated so that the bottom of the groove is substantially an extension of the axis of the drawing frame (1).

A false twist friction spindle (7), with crossed belts for example, is placed downstream of the rotary condensing guide (4). A fiber-delivering system (8) is provided before the re-wind means (9) which, in the illustrated case, will be constituted by a re-wind system with tangential drive, imparting no additional twist to the formed spun yarn. Obviously, a re-wind system imparting an additional twist could also be suitable.

In short, such an installation has a structure similar to that described in the prior patent applications, as cited in the preamble of the present specification, except that it has no additional means permitting delivery of a core yarn.

Indeed, according to the present invention, the core of the spun yarn is obtained directly from the fibers introduced in the common drawing system (1) of the installation.

The only adaptation made resides, as can be seen from FIG. 2, in positioning a guiding element (10), which may be constituted by a ceramic wheel member, and which is placed in such a way that the path followed by the fibers coming out of the drawing rollers (2-3) is so directed that only part of the fibers wrap around the said guiding surface, whereas another part is directed away from said guiding surface (4) to be thereafter brought substantially tangentially to said surface in line with the working area of the false twist spindle (7), downstream of the point where the first part of the fibers is distributed over said guiding surface.

Owing to this simple adaptation, it is possible, by using as fibrous materials fibers of a same or different nature, to obtain directly a core-spun yarn, the core of which is also made of fibers. Preferably, the fibers will be of different length, the longest fibers being used to form either the core or the cover. In the case where the longest fibers are used to form the core, in normal operation, they are then brought around the deviating guide (10) whereas the shorter fibers (12) are projected onto the guiding surface (4), wrapping around the latter to be thereafter confined in the core yarn, the twist communicated by spindle (7) going up along that yarn.

This action of the core catching the fibers (12) takes place in the same way as described in U.S. Pat. No. 4,489,546 cited in the preamble of the present specification, and therefore will not be further described, to keep matters simple.

FIGS. 11, 12 and 13 show a variant embodiment of the invention in which the joint drawing system (1) is constituted by two systems with sleeves (1*a*-1*b*) working in parallel, which is a system currently used in fiber spinning.

According to this variant, one of the systems, for example system (1*a*) delivers the fibers meant to form the cover, whereas the other system (1*b*) delivers the fibers meant to form the core. According to the invention, the fibers coming from system (1*a*) are delivered on a rotary guiding surface (4) and wrap around said surface, whereas the other fibers coming from system (1*b*) and meant to form the core, are brought vertically, tangentially to said surface in line with of the false twist spindle (7). The twist communicated by the spindle (7) goes up as in the previous case, along the formed yarn, and confines the fibers delivered by the drawing system (1). Compared with the previously described embodiments, the condensing guide (4) has a different structure and is generally in the form of a rotary drum situated in parallel to the outlet of the drawing system (1), said rotary drum comprising a perforated part (4*a*), situated on the side of the fiber outlet and a part (4*b*) of larger diameter situated at the rear and for guiding of the fibers. Said condensing element is situated so that the fibers designed to make up the core arrive tangentially to the surface (4*a*), whereas the fibers meant to form the covering part, wrap around said surface.

The following examples are given to illustrate the method according to the invention and the advantages that it brings:

Example 1 is concerned with producing a core-spun yarn according to the invention from a single supply source (tapes for example);

Examples 2, 3, 4, 5 and 6 are concerned with producing a yarn according to the invention in which the elementary fibers come from two different supply sources (rove and/or tape), these materials being brought in parallel inside a joint drawing system;

Example 7 describes one way of using the method according to the invention such as diagrammatically illustrated in FIGS. 11, 12 and 13 in which the elementary fibers come from two separate sources subjected to the action of a common drawing system constituted by two drawing trains working in parallel.

EXAMPLE 1

This example is best illustrated in FIGS. 1-4.

A core-spun yarn is produced according to the invention in the following conditions.

The supplied material is constituted by a tape of cotton formed by a mixture composed of 15% fibers of between 2.8 and 4 cm and 85% short fibers of between 1.5 and 2.8 cm.

Said tape R has a thickness of 33,000 dtex.

It is introduced, as can be seen in FIGS. 1 to 4, flat, inside a single drawing system (1), lateral guides (13-14-15-16) being provided on each side to ensure perfect guidance of the material.

The speed $V_0$ of the last pair of drawing cylinders (2-3) is reduced to 200 m/min.

The guiding surface is constituted by a rotary condensing guide (4), subjected to an internal suction, and turning at a speed of 260 m/min. The surface of this guide is provided with a V-shaped groove inclined at 120°. This guide is situated immediately adjacent to the outlet side of the last pair of drawing cylinders (2-3), so that the bottom of the groove is placed substantially along the axis of the drawing system.

Downstream of said guide a false twist spindle (7) is placed which is constituted by a friction spindle with crossed belts, inclined at 45°, the linear speed of the straps being adjusted to 550 m/min.

The fiber-delivering cylinders (8) have a speed $V_2$ which is substantially equal to the speed $V_0$ of cylinders (2-3) and rewinding is carried out at the same speed.

The spun yarn according to the invention is produced as follows.

A preliminary yarn is first formed, then the totality of the fibers are brought around the deviating guide (10). Thereafter, the shorter fibers continue to be delivered onto the guiding surface (4) whereas the longer fibers are twisted by the action of the spindle (7), the twisting going up to nearly the level of the last pair of drawing cylinders (2-3). The short fibers wrapped around the guiding surface are projected onto the formed core and caught in the twisting movement.

A core-spun yarn comes out of the spindle (7), the core being also constituted by fibers, and the peripheral fibers being perfectly bonded with said core. Said spun yarn measures 330 dtex and shows very good textile properties both from a strength point of view and from a uniformity point of view. It can be used in weaving as well as in knitting.

EXAMPLE 2

Figure 5:
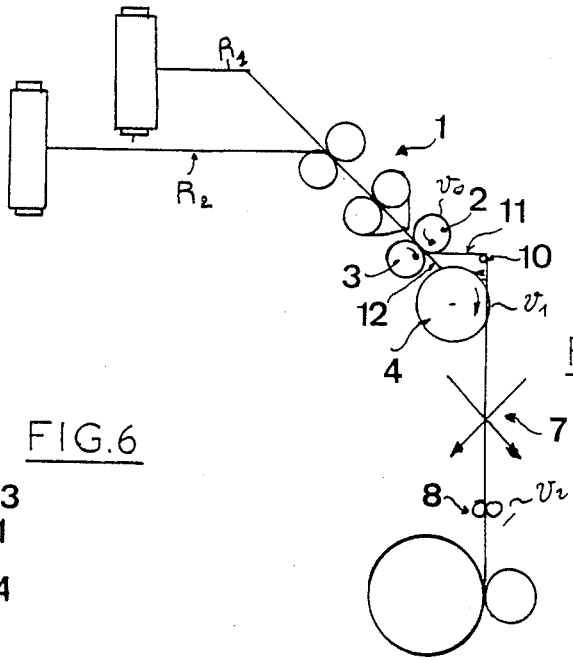
Figure 6:
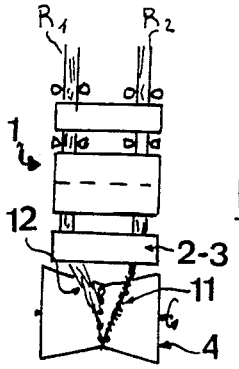

This example is illustrated by FIGS. 5 and 6.

In this example, the supply material is constituted by two roves of cotton (R1–R2), rove R1 being a worsted cotton of 3300 Dtex thickness and rove R2 being also a worsted cotton of 3200 dtex thickness, but with fibers slightly shorter than those of rove R1.

As in the preceding example, the two roves R1 and R2 are introduced simultaneously inside a drawing system (1), but in the present case, they are kept apart one from the other inside the drawing system, as can be seen in FIG. 6.

During the projection operation, rove R1 is first projected and brought around the deviating guide (10). Said rove R1 forms the core of the spun yarn. The spun yarn being thus started, rove R2 is introduced into the drawing system, the two roves R1 and R2 being parallel. The fibers of rove R2 being shorter than rove R1 are projected onto guiding surface (4) to be thereafter brought into contact with core (11) and this in the manner shown in FIG. 2.

In this particular example, and compared for example with the preceding one, the installation is set to work as follows:

| | |
|---|---|
| speed $V_0$ of drawing cylinders (2–3): | 150 m/min. |
| speed $V_1$ of guiding surface: | 210 m/min. |
| linear speed of the belts of spindle (7): | 400 m/min. |
| speed $V_2$ of drawing cylinder (8): | 149 m/min. |

The resulting core-spun yarn has a thickness of 200 dtex and its core and covering part are made up of cotton fibers.

Such a spun yarn can be used either for weaving or knitting.

EXAMPLE 3

Figure 10:
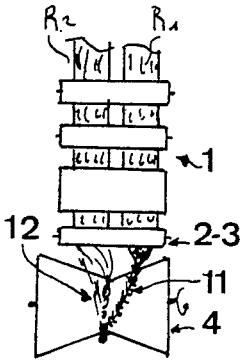
Figure 9:
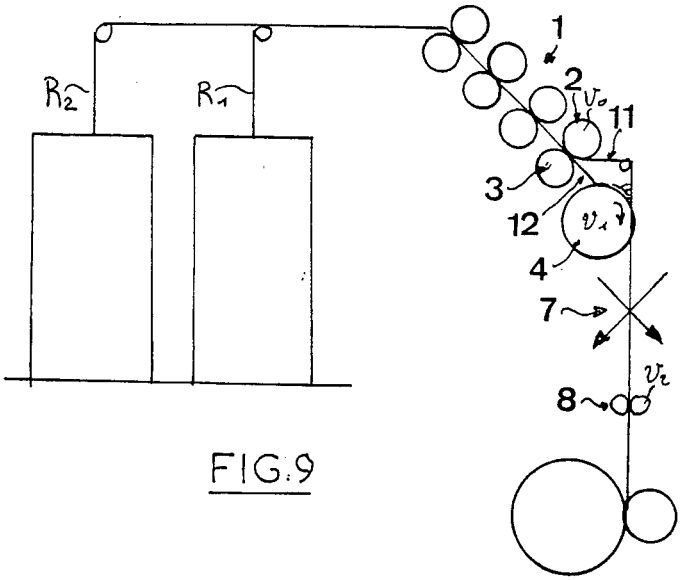

This example is illustrated by FIGS. 9 and 10.

In this example, the supply material consists in two tapes R1 and R2.

Tape R1 is a polyester tape of 33,000 dtex thickness, the cut length of polyester being 40 mm.

Tape R2 is a cotton tape, also of 33,000 dtex thickness, the average length of cotton being 30 mm.

In this example, the polyester fibers are, when emerging from the drawing cylinders (2) and (3) deviated around guide (10) whereas the cotton fibers are projected onto the guiding surface (4).

The machine is set to work as follows:

| | |
|---|---|
| speed $V_0$ of cylinders (2–3): | 150 m/min. |
| speed $V_1$ of the guide (4): | 210 m/min. |
| linear speed of belts of spindle (7): | 400 m/min. |
| speed $V_2$ of drawing cylinders (8): | 149 m/min. |

The resulting core-spun yarn has a thickness of 280 dtex and a core constituted by polyester fibers and a cover constituted of cotton fibers.

EXAMPLE 4

Figure 8:
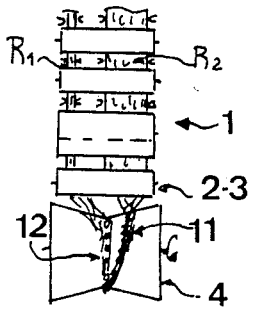
Figure 7:
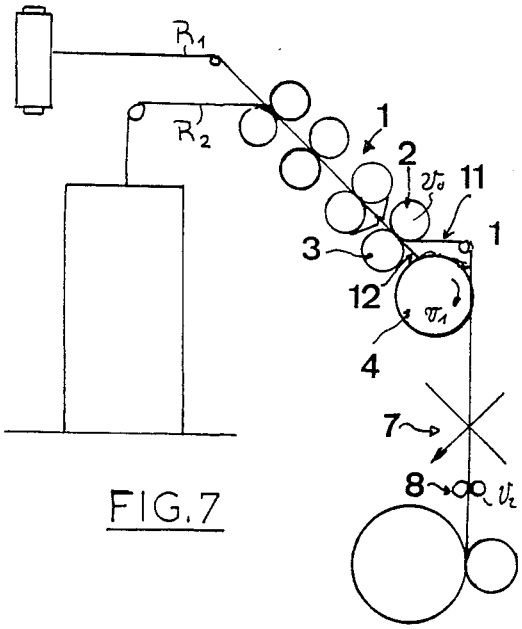

This example is illustrated by FIGS. 7 and 8.

In this example, the supply material is constituted, on the one hand, by a rove of polyester R1, and on the other hand, by a cotton tape R2.

The polyester rove is a rove of 4800 Dtex thickness and is composed of 40 mm-long fibers.

The cotton tape is a tape of 33,000 dtex thickness, the cotton fibers being about 30 mm-long.

The two supply materials R1 and R2 are brought in parallel into the drawing system (1) in the manner illustrated in FIG. 8. They are kept apart by means of lateral guides.

In this example, the cotton fibers are deviated around the guide (1) whereas the polyester fibers are projected onto the guiding surface (4) to be thereafter delivered onto the cotton core (11).

The operational conditions are as follows:

| | |
|---|---|
| speed $V_0$ of cylinders (2–3): | 200 m/min. |
| speed $V_1$ of the guide: | 260 m/min. |
| linear speed of belts of spindle (7): | 550 m/min. |
| speed $V_2$ of drawing cylinder (8): | 198 m/min. |

The resulting core-spun yarn is essentially constituted of cotton fibers and covered with polyester fibers.

EXAMPLE 5

This example is similar to Example 4, except that the materials are reversed and that a rove of cotton R1 and a tape of polyester R2 are used.

In this example, the polyester fibers are deviated around the guide (10) whereas the cotton fibers are projected onto the guiding surface (4) to be thereafter delivered onto the polyester core (11).

The operational conditions are as follows:

| | |
|---|---|
| speed $V_0$ of cylinders (2–3): | 300 m/min. |
| speed $V_1$ of the guide (4): | 360 m/min. |
| linear speed of belts of spindle (7): | 750 m/min. |
| speed $V_2$ of drawing cylinders (8): | 296 m/min. |

A core-spun yarn is obtained with a core essentially constituted of polyester fibers and which is covered with cotton fibers.

Such a spun yarn can also be used, as is, in weaving and knitting.

EXAMPLE 6

This example is similar to example 2 except that a rove of polyester and a rove of cotton are used, of some thickness 3300 Dtex.

A core-spun yarn is obtained, with a core constituted of polyester, the cotton fibers forming the covering part.

Said spun yarn can also be used in weaving and knitting.

EXAMPLE 7

This example is illustrated in FIGS. 11, 12 and 13.

Compared with the other examples, the joint drawing system (1) which is used is a system composed of two drawing trains (**1*a*–1*b*). At the outlet of said parallel drawing trains (1*a*–1*b*) is placed a movable guiding surface (4) which is in the form of a rotary drum with a perforated cylinder portion (4*a*) disposed latarally with respect to a part of larger diameter (4*b*). This rotary guide is arranged in parallel to the outlet of the drawing system (1*a*–1*b*), the fibers coming from system (1*a*) being deviated and brought to wrap around the surface (4*a*), whereas those coming from system (1*b*) pass tangentially to said surface (4*a***) and are brought directly to the false twist spindle (7). The twisting movement imparted by spindle (7) goes up along the formed spun yarn, substantially adjacent to the outlet of the drawing system (1–2), The fibers coming from system (1*a*) are confined in the formed core.

With this type of installation, the spun yarn is produced by using as supply material a rove of cotton R1 and a rove of polyester R2, each of 3300 Dtex.

The cotton fibers are introduced into the drawing system (1*a*) and are deviated when coming out of the drawing cylinders (2–3) to be brought onto the guiding surface (4) in such a way as to wrap around said surface. The polyester fibers R2 are introduced into the drawing system (1*b*) and are brought vertically, in parallel to the guiding surface (4), downstream of the cotton fibers.

The installation is set to work as follows:

| | |
|---|---|
| speed $V_0$ of cylinders (2–3): | 300 m/min. |
| speed $V_1$ of the guide (4): | 360 m/min. |
| linear speed of belts of spindle (7): | 750 m/min. |
| speed $V_2$ of drawing cylinder (8): | 296 m/min. |

The spun yarn with core which is obtained has a core constituted essentially of polyester fibers and covered with cotton fibers.

The preceding example clearly shows the advantages brought by the invention and in particular the fact that it is possible, without any particular adaptation, to obtain a very large number of different yarns from the same installation.

It has been found that by proceeding according to the invention it was possible, not only to obtain fiber core-spun yarns of very good quality, but also to virtually eliminate nearly all losses of fibers. Moreover, the resulting spun yarn can be used as is without having to undergo any extra twisting, although an extra twisting is possible if required.

What we claim is:

1. A process for making a fiber-spun yarn of the type comprising an internal core formed of discontinuous fibers, said core being covered with an external sheath also formed of discontinuous fibers, of the type according to which:

the fibers forming the inner core are subjected to a momentary false twist operation by a false twist spindle; and elementary fibers are projected onto the liner core upstream of the false twist spindle by means of a movable guiding surface onto which said elementary fibers are tangentially delivered and which has a tendency to exert a pulling force on a free end of said elementary fibers, said core being moved tangentially with respect to said guiding surface along a direction which converges with the direction in which the fibers are moved by said guiding surface, wherein the improvement comprises:

drawing both the fibers which will make up the internal core and the fibers which will make up the external sheath with a common drawing system; and at an outlet of the drawing system, delivering a first part of the drawn fibers onto the movable guiding surface, and directing a second part of said fibers initially away from said movable guiding surface, but then directing said second part of the fibers into tangential contact with the moving guiding surface downstream of the location where the first part of the fibers is delivered to the movable guiding surface, said first part of the fibers thereby forming the external sheath and said second part the internal core.

2. The method as claimed in claim 1, wherein the fibers forming the internal core and the fibers forming the external sheath are comprised of the same materials.

3. The method according to claim 1, wherein the fibers forming the internal core and the fibers forming the external sheath are comprised of differing materials.

4. The method according to claim 1, wherein the fibers forming the internal core are longer than the fibers forming the external sheath.

5. The method according to claim 1, wherein both the fibers for forming the internal core and the fibers for forming the external sheath are drawn by the common drawing system intermixed as a single rove or tape.

6. The method according to claim 1, wherein the fibers for forming the internal core and the fibers for forming the external sheath are drawn by the common drawing system as separate roves or tapes.

7. The method according to claim 1, wherein the movable guiding surface moves the fibers forming said external sheath in a direction substantially parallel to the direction in which they leave the drawing system.

8. The method according to claim 1, wherein the movable guiding surface moves the fibers forming said external sheath in a direction substantially transverse to the direction in which they leave said drawing system.

* * * * *